US009416516B2

(12) United States Patent
Stadler

(10) Patent No.: US 9,416,516 B2
(45) Date of Patent: Aug. 16, 2016

(54) PRESSURE RESPONSIVE LOCKING LATCH ARRANGEMENT FOR MANHOLE COVERS

(71) Applicant: Neenah Foundry Company, Neenah, WI (US)

(72) Inventor: David Stadler, Lathrup Village, MI (US)

(73) Assignee: NEENAH FOUNDRY COMPANY, Neenah, WI (US)

( * ) Notice: Subject to any disclaimer, the term of this patent is extended or adjusted under 35 U.S.C. 154(b) by 0 days.

(21) Appl. No.: 14/625,766

(22) Filed: Feb. 19, 2015

(65) Prior Publication Data

US 2016/0053458 A1 Feb. 25, 2016

Related U.S. Application Data

(60) Provisional application No. 62/070,421, filed on Aug. 25, 2014.

(51) Int. Cl.
*E02D 29/00* (2006.01)
*E02D 29/14* (2006.01)

(52) U.S. Cl.
CPC ..... *E02D 29/1436* (2013.01); *E02D 29/1418* (2013.01); *E02D 29/1427* (2013.01); *E02D 29/1463* (2013.01)

(58) Field of Classification Search
CPC ..... E02D 29/1427; E02D 29/1481; E02D 29/1418; E02D 29/1436; E02D 29/1463
USPC ..... 404/25; 52/19, 20
See application file for complete search history.

(56) References Cited

U.S. PATENT DOCUMENTS 5,062,735 A * 11/1991 Gaudin ..... E02D 29/14 210/164
6,350,081 B1 * 2/2002 Khajavi ..... E02D 29/1436 404/25
6,764,261 B1 7/2004 Stadler
7,171,994 B1 * 2/2007 O'Brien ..... B65D 90/24 141/311 A (Continued)

FOREIGN PATENT DOCUMENTS

AU 2013203172 5/2013
EP 2 685 009 1/2014
WO WO-2004/018787 3/2004

OTHER PUBLICATIONS

European Search Report Issued for European Patent Application No. 15182087.5, issued Dec. 22, 2015, 4 pages.

(Continued)

*Primary Examiner* — Raymond W Addie
(74) *Attorney, Agent, or Firm* — Foley & Lardner LLP

(57) ABSTRACT

A manhole cover assembly is adapted to be received in an opening in a frame enclosing a vault chamber. A manhole cover is fit into the opening. A pair of lugs are mounted to an underside of said manhole cover on opposite sides thereof. Each lug has a portion projecting radially out in a first position so as to engage a fixed feature of said frame. At least one of said lugs is connected to a pivotable member having an upper end projecting up through said manhole cover so that said upper end is engageable to be able to be rotated and cause rotation of said lug therewith between the first position and a second position with said lug not projecting radially out such that the lug radially clears said fixed feature of said frame to allow said manhole cover to be moved up and out of said frame opening.

6 Claims, 5 Drawing Sheets

(56) References Cited

U.S. PATENT DOCUMENTS

| | | | | |
|---|---|---|---|---|
| 7,484,908 | B2 | 2/2009 | Stadler | |
| 7,712,995 | B2 | 5/2010 | Stadler | |
| 7,748,927 | B2 | 7/2010 | Neathery | |
| 7,891,904 | B2 | 2/2011 | Stadler | |
| 8,784,000 | B2 * | 7/2014 | Reynolds | E02D 29/14 404/25 |
| 8,794,865 | B2 | 8/2014 | Stadler | |
| 9,004,810 | B2 | 4/2015 | Reynolds et al. | |
| 2007/0223997 | A1 * | 9/2007 | Fuchs | E02D 29/1427 404/25 |
| 2010/0028077 | A1 * | 2/2010 | Stadler | E02D 29/1436 404/25 |
| 2013/0221688 | A1 | 8/2013 | Stadler | |
| 2014/0169876 | A1 | 6/2014 | Reynolds et al. | |

OTHER PUBLICATIONS

U.S. Appl. No. 62/090,018, filed Dec. 10, 2014, Stadler, David M.
U.S. Appl. No. 61/974,626, Stadler David M.

* cited by examiner

PRESSURE RESPONSIVE LOCKING LATCH ARRANGEMENT FOR MANHOLE COVERS

CROSS REFERENCE TO RELATED PATENT APPLICATIONS

This application claims the benefit of U.S. provisional patent application Ser. No. 62/070,420 filed on Aug. 22, 2014; and U.S. Ser. No. 62/070,421 filed on Aug. 25, 2014.

BACKGROUND OF THE INVENTION

This invention concerns manhole covers and more particularly latching systems for manhole covers which may be locked to prevent removal by unauthorized persons but which may selectively be unlocked to allow removal by an authorized person when necessary (see U.S. Pat. No. 6,764,261.

The present inventor has also previously developed manhole latching systems which allow relief of gas pressures developed in a covered vault in case of an explosion in order to prevent damage to the vault while preventing launching of the manhole cover into the air entirely free of the frame, see U.S. Pat. Nos. 7,484,908 and 7,712,995 for a description of such a manhole locking system.

In an explosion of flammable gases, the vault chamber which is covered by a manhole cover, the cover described therein is allowed to rise up off the frame to a limited extent due to a clearance between latching lugs and a frame stop feature which is forcefully contacted by the lugs in an explosion driving the manhole cover up against the stop.

This forcible contact causes severe stress due to the great upward speed of a cover blown up by an explosion in the vault chamber. This stress creates a potential failure of the lug with the possibility that the cover can be blown free of the frame, presenting a safety hazard from the flying cover and the subsequent absence of a cover over the vault chamber.

Another disadvantage of selectively releasable latching systems controlling removal of the cover is the significant costs involved in adding the latching components to manhole covers.

Vault chamber explosions are of varying severity, and it would be advantageous to minimize the height the cover moves up in safely dissipating the explosion induced stresses. That is, it would reduce the hazards to passing traffic if the height the cover reaches for an explosion of lesser severity were reduced.

Flooding of the chamber with water can similarly create a need for allowing the cover to rise up off its seat in the frame while preventing the manhole cover from being washed completely free of the frame.

It is an object of the present invention to provide a manhole cover latching system which in an explosion allows the cover to rise up off its seat in the frame but cushions the impact of the lugs with the aligned stops to minimize the chances of lug breakage and consequent escape of the manhole cover from the frame.

It is a further object of the present invention to provide a low cost selectively operated latching system.

It is also an object of the invention to provide a manhole latching system which can relieve pressure caused by flooding or explosion events in the covered vault chamber while minimizing the height to which the manhole cover rises while dissipating the pressures developed in the vault chamber from such events.

SUMMARY OF THE INVENTION

The above objects and other objects which will be understood by those skilled in the art upon a reading of the following specification and claims are achieved by mounting one or more latching lugs on a manhole cover so as to be moveable by forces developed when contacting a frame feature in an explosion or flooding event in order to reduce the stress experienced by the lug.

This movement may be resisted by a countering force increasing with the extent of movement of an elongated operator member connected to the lug extending in an upward direction therefrom.

This countering force can be developed by compression of a cushioning spring by engagement therewith of the operator member, or by compression of air confined in a space through which the member travels when the cover rises up.

An increasing gap can thereby be developed between the manhole cover and the frame as the fluid pressure developed in the vault chamber increases to create a larger sized gap to increase the extent of relief of that pressure produced by thereby increasing the area of the opening available for the outflow of gases (or water) from the vault chamber.

According to a second aspect of the invention, one of the lugs is mounted to be selectively pivotable about an axis perpendicular to the lug by rotation of the elongated member which has an upper end exposed to be accessible from above the manhole cover to be rotated as with a specially configured security tool mating with a drive feature in the exposed upper end of the member.

The operator member is mounted within a bore formed in a downward projecting feature cast into the manhole cover itself to eliminate the need to assemble a separately fabricated housing to reduce the cost of the latching mechanism.

In a first rotary position of the operator member, the attached lug projects radially outwardly so as to engage a shoulder or other stop feature on the frame when the manhole cover rises up from its rest position in the frame in the event of an explosion or flooding event When the operator member is rotated to project the lug in the opposite direction, the lug will not engage the frame stop feature when the manhole cover is lifted up out of its at rest position to allow removal of the manhole cover by being lifted up and dragged to one side of the frame opening.

The cushioning spring engages a head portion of the operator member, which draws the lug upwardly against the cover housing feature in the rest position with detent balls interposed and seated in depressions when the operator element and lug are in either a locked or a released position to inhibit inadvertent movement out of either position.

DESCRIPTION OF THE DRAWING FIGURES

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
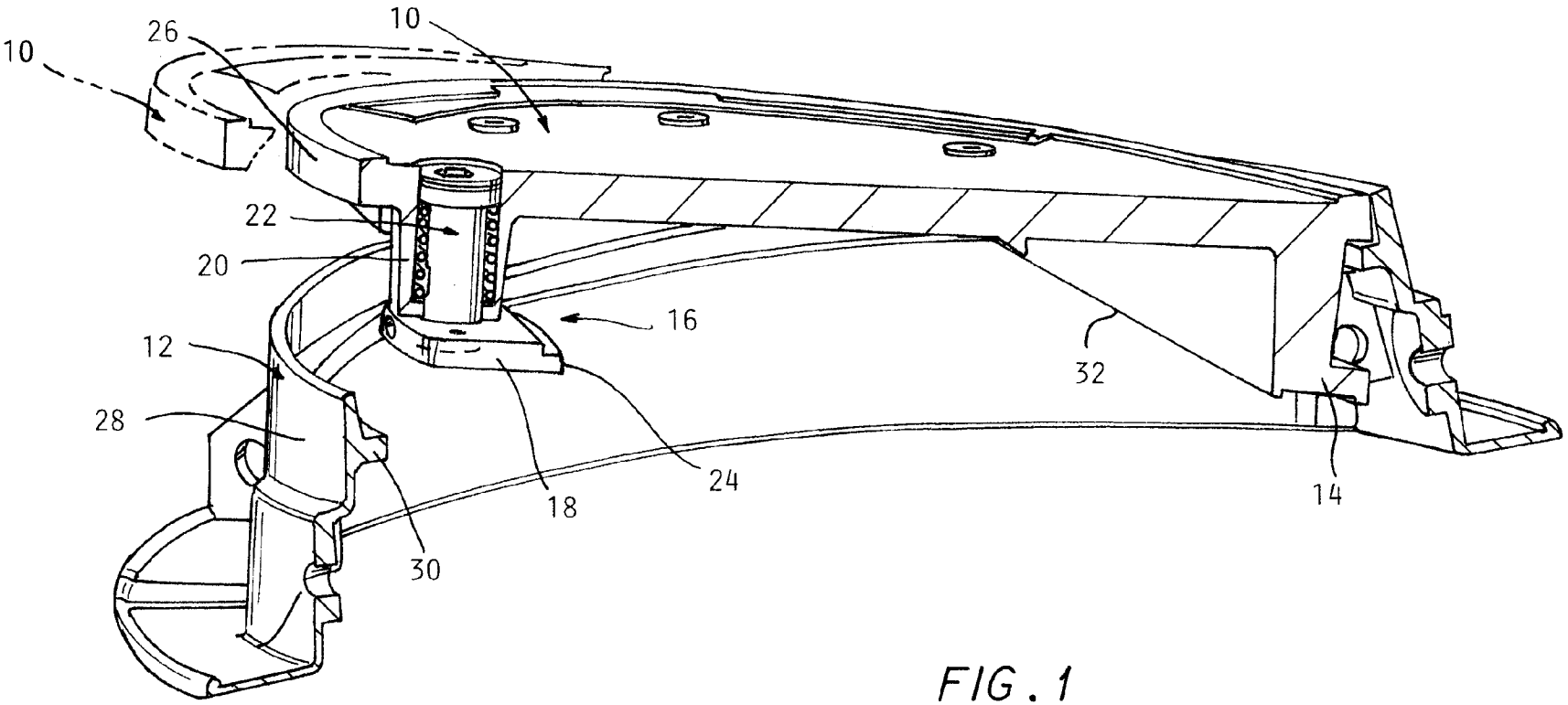
FIG. 1 is a partially sectional pictorial view of a manhole cover and housing frame with a lug of a locking mechanism rotated to a release position.

Referring to the drawings and particularly FIG. 1, a manhole cover 10 is shown tilted up on one side out of an enclosing frame 12 conventionally recessed to a paved surface (not shown).

A fixed lug 14 is integral with the manhole cover 10 and located on one side thereof. Opposite the fixed lug 14 is a repositionable locking mechanism 16, which includes a stepped lug member 18 pivotally mounted at the bottom of a cast in tubular feature functioning as a housing 20 for a headed elongated operator member 22 slidable and rotatable within the housing 20.

In the position shown in FIG. 1, a stepped end 24 projects radially inward away from the rim 26 of the manhole cover 10 and the rim 28 of the frame 12 which has a projecting shoulder 30 formed therein.

This relationship allows the manhole cover 10 to be tipped up and out of the frame 12 as shown in FIG. 1. The manhole cover 10 can then be dragged sidewise as shown in phantom lines in FIG. 1 to allow complete removal of the manhole cover 10.

A sloping ramp web or webs 32 can be provided to assist movement of the cover 10 out of the frame 12. Other features such as a roller or sloping supports could also be used as has become the practice in the field and described before.

The headed member 22 has security wrenching tool engagement features 24 formed in an exposed upper surface 36 of a head portion 38.

A specially configured tool (not shown) can be used to rotate the member 22 to turn the stepped projection 24 to project radially out towards the rim 26.

Figure 2:
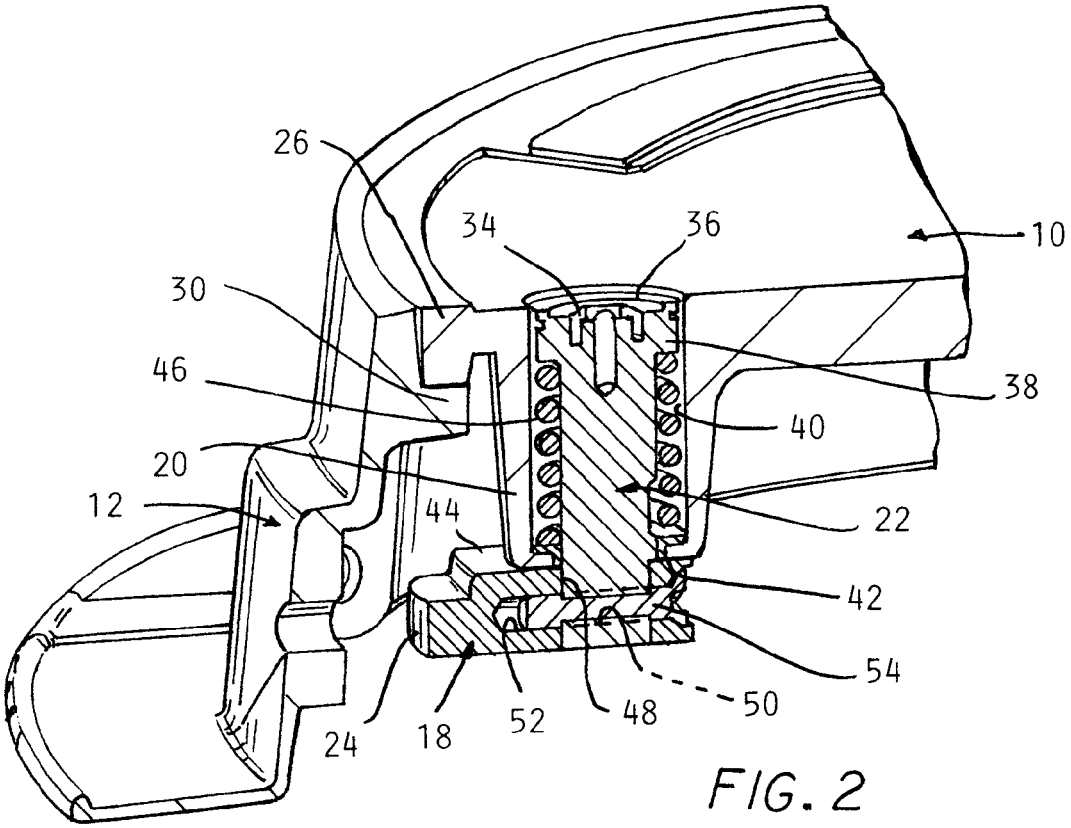
FIG. 2 is a fragmentary partially sectional view of the manhole cover showing details of the locking mechanism included in the manhole cover shown in FIG. 1, which the lug engaging a frame shoulder to prevent further rise of the manhole cover.

In this position the projection 24 will be beneath the frame shoulder 30 (with a vertical clearance space therebetween as shown in FIG. 2.

The housing 20 has an internal space 40 which slidably receives the member 22, open at the upper end to expose the upper end 36, and partially closed at the lower end by end wall 42 which is held abutting the upper surface 44 by a spring 46 is compressed between the underside of the head portion 38, and the inside of the end wall 42.

The lower end of the member 22 extends through an opening in the end wall 42 and into an opening 48 through the upper surface lug 18 to bring a threaded cross bore 50 in its lower alignment with a cross bore 52 in the lug 18.

A retainer screw 54 is threaded into the cross bore 50 and received in the cross bore 52 to attach the lug 18 to the member 22 to vertically move together therewith.

Figure 3:
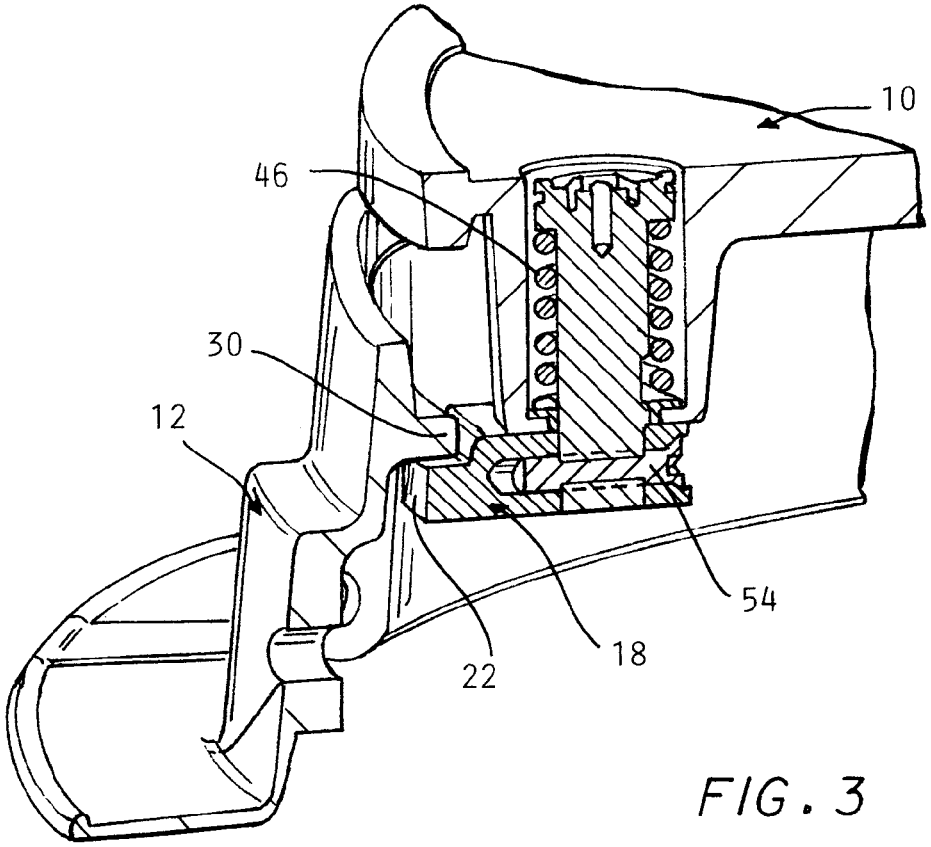
FIG. 3 is the same view as FIG. 2 but with the lug rotated to the locking condition and with the manhole cover elevated to bring the lug into engagement with the frame shoulder.
Figure 4:
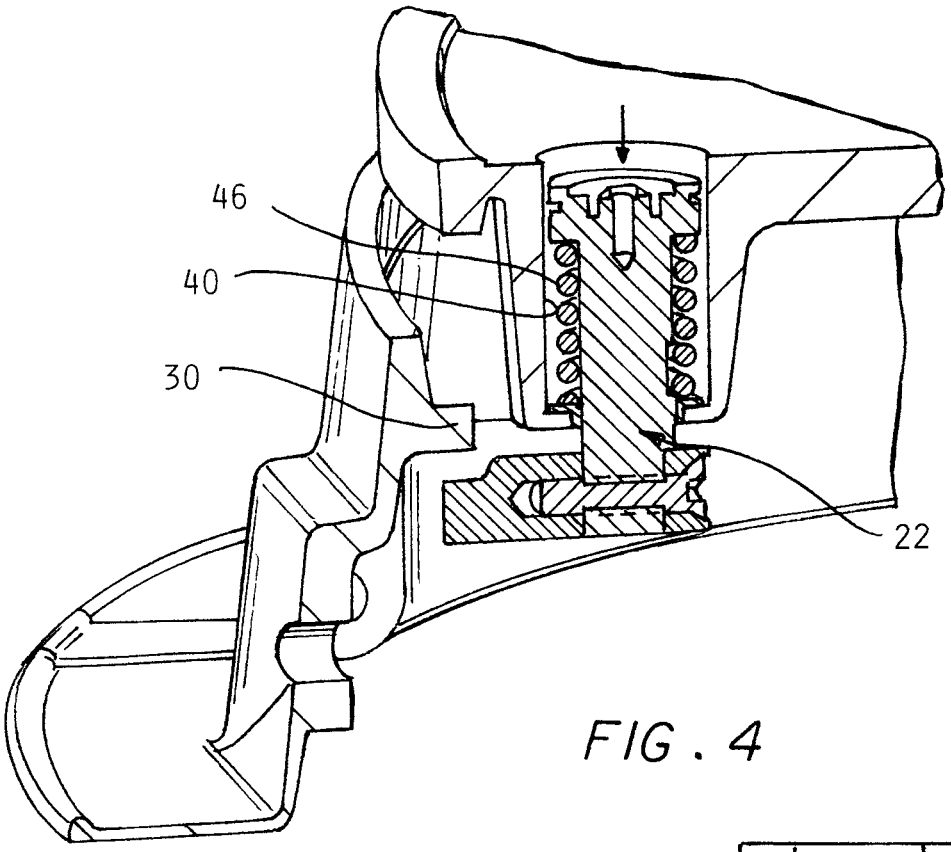
FIG. 4 is the same view as FIGS. 2 and 3 but with a headed element included in the locking mechanism descended to increase a clearance space between the manhole cover and the frame.
Figure 5:
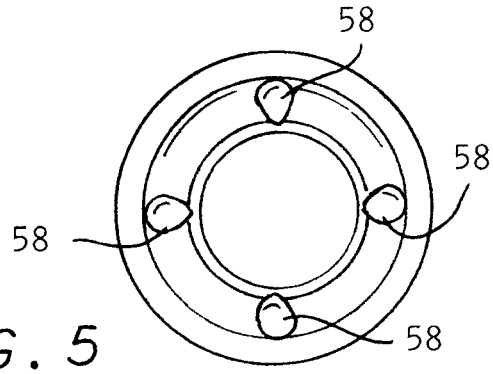
FIG. 5 is an end view of an integral housing feature which receives the headed operator element showing the ball detent seats.
Figure 7:
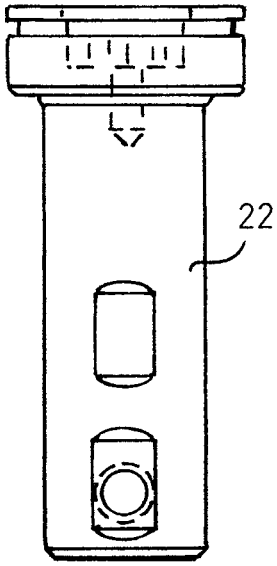
FIG. 7 is a side view of the headed operator element included in the locking mechanism shown in FIGS. 1-4.
Figure 6:
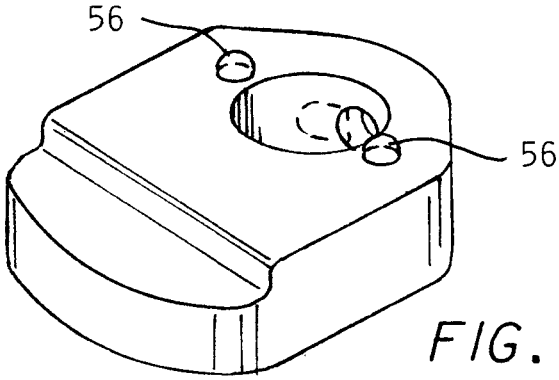
FIG. 6 is a pictorial view of the lug included in the locking mechanism shown in FIGS. 1-4 showing the detent balls engaging the detent seats on the housing shown in FIG. 5.

The cover 10 can rise as in an explosion event so that the lug projection 24 will engage the underside of the shoulder 30 as seen in FIG. 3.

Due to the presence of the spring 46 (or a compressible volume of air in the chamber 40), the cover 10 can continue to rise if the force exerted is sufficient to compress the spring 46 (or volume of air) as seen in FIG. 3. This compression will cushion the impact of the cover 16 with the shoulder 30 to reduce the stress imposed therein. In addition, the height to which the cover 10 will rise will correspond to the level of force exerted on the cover by an explosion or an upwelling of water in the vault within the frame 12. Thus, the rise of the cover is minimized safely while allowing dissipation of pressurized gases (or water geyser) to avoid damage to the vault and preventing escape of the manhole cover 10.

A detent arrangement is provided to locate and releasably hold the lug 18 in either the locked or released rotary positions.

This detent arrangement can take the form of a set of balls 56 disposed in pockets in the lug 18, and pairs of pockets 58 recessed into the end wall 42.

The spring 46 pulls the top of the lug 18 against the end wall 42 so that the lug 18 will be held in the relative position assumed once the lug 18 is tuned to bring the balls 56 into alignment with a set of pockets 58 on the end wall 42.

It takes some force to rotate the member 22 so as to rotate past the balls 56 such that the member 22 will be retained in either the radially inward or radially outward extending position absent an exertion of a predetermined torque on the member 22.

Figure 8:
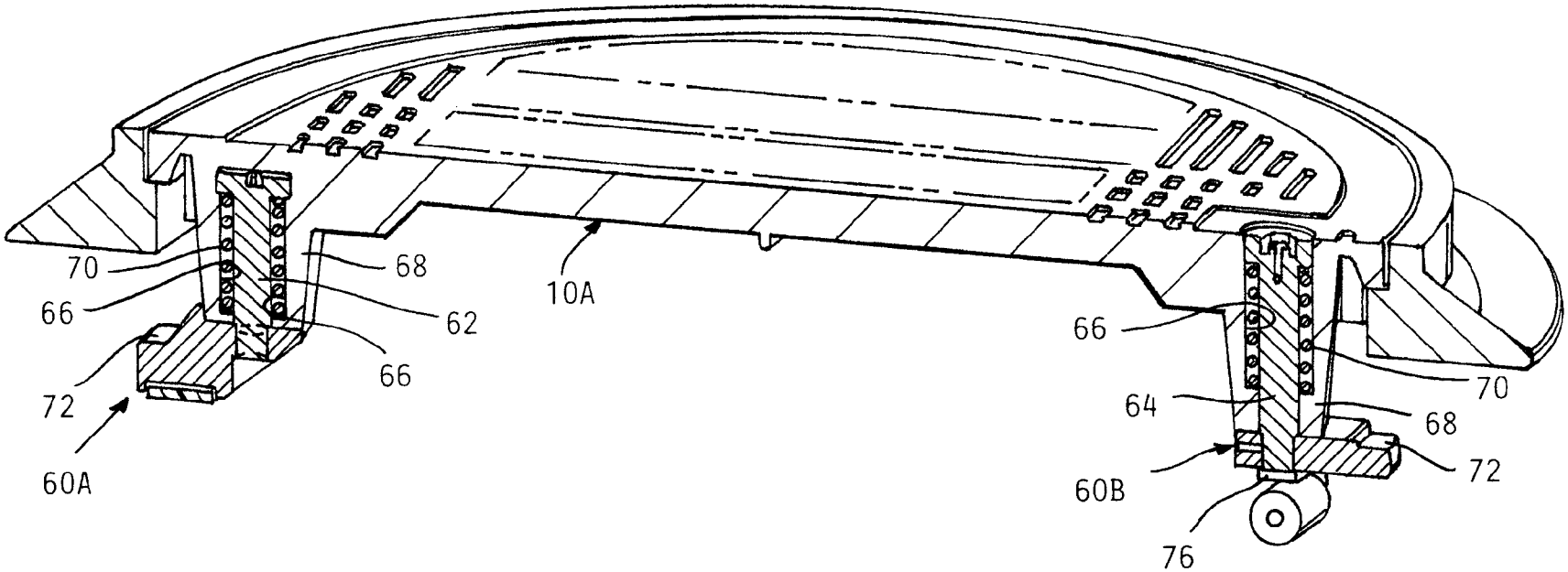
FIG. 8 is a sectional pictorial view of another embodiment of a manhole cover equipped with a locking mechanism.

Referring to FIG. 8, a manhole cover 10A is provided with two axially movable stepped lugs 60A, 60B, each attached to a respective headed elongate member 62, 64.

Headed member 62 is vertically slidable in a bore 66 formed in an integrally cast housing 68 projecting down from the underside of manhole cover 10A.

A spring 70 creates resistance to downward movement of members 62, 64 after the lug stepped end 72 engages.

A roller 74 attached by a bracket 76 to the bottom of assembly 60B when removing the same.

Figure 9:
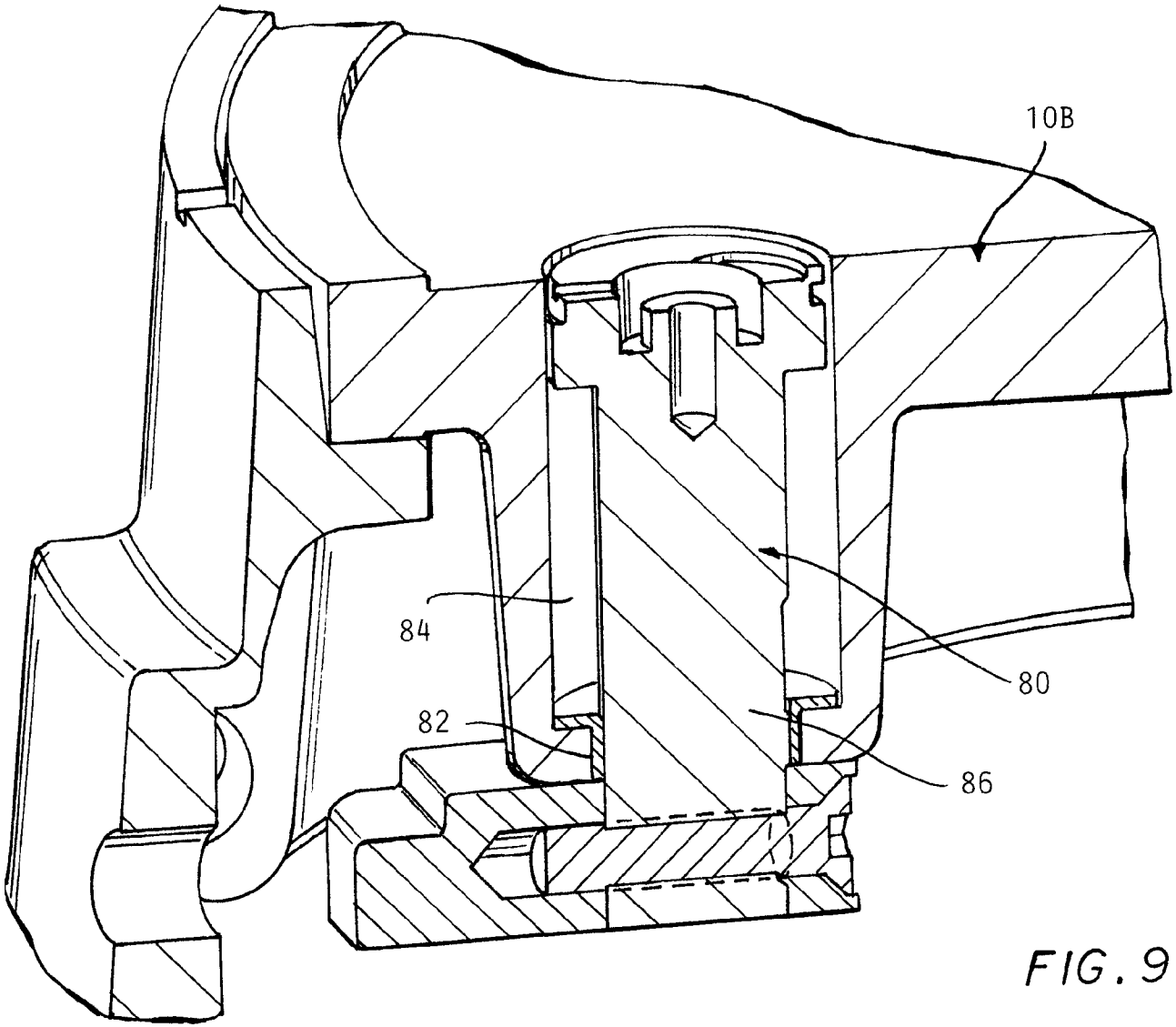
FIG. 9 is an enlarged fragmentary view of a portion of yet another embodiment of a manhole cover.

FIG. 9 shows a springless design, in which the air is forced through a clearance between a headed piston 80 and a bushing 82, the air in space 84 also being compressed to create a cushioning resistance to upward movement of the cover 10B.

Work is done in forcing air past the stem 86, effectively dissipating the energy imparted to the cover 10B by the explosion to a substantial extent.

The invention claimed is:

1. A manhole cover assembly adapted to be received in an opening in a frame enclosing a vault chamber, comprising:

a manhole cover fit into the opening defined by said frame;

a pair of lugs mounted to an underside of said manhole cover on opposite sides thereof each lug having a portion projecting radially out from a bottom of the manhole cover manhole cover in a first position so as to engage a fixed feature of said frame located beneath said cover receiving frame opening so as to prevent said cover from being moved up and free of said frame;

at least one of said lugs connected to a lower part of a rotational member having an upper end projecting up through said manhole cover so that said upper end is engageable to be able to be rotated and cause rotation of said lug therewith between the first position with said portion projecting radially out, and a second position with said portion of said lug not projecting radially from a bottom of the manhole cover such that said lug radially clears said fixed feature of said frame to allow said manhole cover to be moved up and out of said frame opening; and a mounting for said one lug to the underside cover allowing said one lug to be movable vertically downwardly relative to said cover after engaging said feature of said frame.

2. The manhole cover assembly according to claim 1, wherein said one lug is movable vertically downwardly relative to said cover after engaging said feature of said frame upon development of a pressure in said chamber to overcome a resisting force generated by compression of a resiliently compressible constituent of said mounting compressed by downward movement relative to said manhole cover of said lug and connected rotational member, whereby the extent of said downward movement of said lug and said rotational member corresponds to the level of force exerted thereon by said manhole cover when said manhole cover is driven up by pressure conditions in said vault chamber and lug engages said frame feature to arrest any further upward movement of said lug and rotational member with said manhole cover; said downward movement of said lug and rotational member relative to said manhole cover allowing said manhole cover to rise further out of said frame opening.

3. The manhole cover assembly according to claim 2 wherein said rotational member is slidably mounted vertically relative to said manhole cover by said mounting and wherein said mounting constituent is a spring element compressed by a feature on said rotational member upon downward movement thereof relative to said manhole cover.

4. The manhole cover assembly according to claim 3 wherein said spring element includes a helical spring surrounding said rotational member and having a head feature engaging said helical spring to compress the same upon undergoing vertical downward movement relative to said manhole cover.

5. The manhole cover assembly according to claim 3 wherein said compressible constituent of said mounting comprises a cavity through which a head portion of said rotational member is moved when said rotational member moves downwardly when relatively moving with respect to said manhole cover, said cavity containing atmospheric air which is compressed by said movement of said head portion to generate said resisting force.

6. The manhole cover assembly according to claim 5 wherein said air in said cavity is driven out of said cavity through a restricted path to thereby dissipate energy of said manhole cover acting on said rotational member through compression of said air in said cavity after said lug engages said feature to arrest any further upward movement of said lug.

* * * * *